US011027546B2

(12) United States Patent
Komamiya et al.

(10) Patent No.: US 11,027,546 B2
(45) Date of Patent: Jun. 8, 2021

(54) LIQUID DISCHARGE HEAD AND RECORDING APPARATUS

(71) Applicant: CANON KABUSHIKI KAISHA, Tokyo (JP)

(72) Inventors: Yumi Komamiya, Kawasaki (JP); Satoshi Kimura, Kawasaki (JP); Shingo Okushima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/527,791

(22) Filed: Jul. 31, 2019

(65) Prior Publication Data

US 2020/0047498 A1 Feb. 13, 2020

(30) Foreign Application Priority Data

Aug. 7, 2018 (JP) ..... JP2018-148579

(51) Int. Cl.
*B41J 2/14* (2006.01)
*B05B 17/00* (2006.01)
*B41J 2/155* (2006.01)

(52) U.S. Cl.
CPC ..... *B41J 2/14* (2013.01); *B05B 17/0646* (2013.01); *B41J 2/155* (2013.01)

(58) Field of Classification Search
None
See application file for complete search history.

(56) References Cited

U.S. PATENT DOCUMENTS

2002/0030715 A1* 3/2002 Takata ..... B41J 2/17553 347/37
2005/0157076 A1 7/2005 Silverbrook et al.
2007/0040867 A1* 2/2007 Silverbrook ..... B41J 2/04 347/54
2007/0165071 A1 7/2007 Hirota et al.
2007/0242109 A1 10/2007 Ito
2012/0007926 A1 1/2012 Kawamura
2015/0210072 A1* 7/2015 Sumiyoshi ..... B41J 2/0458 347/10
2016/0257118 A1 9/2016 Kobayashi et al.
2017/0291417 A1 10/2017 Okubo et al.
2017/0341391 A1 11/2017 Mori et al.

FOREIGN PATENT DOCUMENTS

CN 101224673 A 7/2008
CN 103052507 A 4/2013
JP 2011240519 A 12/2011

* cited by examiner

*Primary Examiner* — Erica S Lin

(74) *Attorney, Agent, or Firm* — Canon U.S.A., Inc., IP Division

(57) ABSTRACT

A liquid discharge head includes a recording element substrate including a discharge port. A channel member is configured to supply the recording element substrate with a liquid. An electric wiring board is configured to supply the recording element substrate with power. A plate-like protective member is directly or indirectly fixed to the channel member. In a case where a direction in which the recording element substrate is viewed from the channel member is defined as downward, the protective member includes a first bent portion configured to be bent in a transverse direction of the liquid discharge head. The first bent portion is located at a position that is above an upper end of the channel member and below a midpoint of a line segment connecting the upper end of the channel member and an upper end of the protective member.

22 Claims, 19 Drawing Sheets

LIQUID DISCHARGE HEAD AND RECORDING APPARATUS

BACKGROUND OF THE DISCLOSURE

Field of the Disclosure

The present disclosure relates to a liquid discharge head and a recording apparatus including the liquid discharge head.

Description of the Related Art

If static electricity, ink mist, or the like is attached to an electric wiring board mounted on a liquid discharge head, or if a physical contact occurs between the electric wiring board and the outside, there may be an adverse effect on recording quality. Accordingly, there is a need to protect the electric wiring board against various external factors. Japanese Patent Application Laid-Open No. 2011-240519 discusses a configuration in which an electric wiring board is covered with a plate-like shield member. According to this configuration, it is possible to suppress adverse effects of static electricity on the electric wiring board.

In particular, depending on the situation where a page-wide liquid discharge head is driven, a plate-like protective member is deformed due to heat generated in the liquid discharge head, or a change in ambient temperature, which may lead to bending of the liquid discharge head.

SUMMARY OF THE DISCLOSURE

According to an aspect of the present disclosure, a liquid discharge head includes a recording element substrate including a discharge port configured to discharge a liquid, a channel member configured to support the recording element substrate and supply the recording element substrate with the liquid, an electric wiring board placed on a side surface of the channel member extending in a longitudinal direction of the liquid discharge head, the electric wiring board being configured to supply the recording element substrate with power, and a plate-like protective member directly or indirectly fixed to the channel member to cover the electric wiring board. In a case where a direction in which the recording element substrate is viewed from the channel member is defined as downward, the protective member includes a bent portion configured to be bent in a transverse direction of the liquid discharge head, the first bent portion being located at a position that is above an upper end of the channel member and below a midpoint of a line segment connecting the upper end of the channel member and an upper end of the protective member.

Further features and aspects of the present disclosure will become apparent from the following description of example embodiments with reference to the attached drawings.

DESCRIPTION OF THE EMBODIMENTS

The present disclosure is directed to providing a liquid discharge head capable of preventing bending of the liquid discharge head, while protecting an electric wiring board against static electricity, mist, a physical contact, and the like.

A liquid discharge head according to an example embodiment of the present disclosure will be described below with reference to the accompanying drawings. However, the following description is not intended to limit the scope of the present disclosure. For example, in the present example embodiment, a thermal method for discharging a liquid by generating air bubbles using a heating element is employed for the liquid discharge head. However, the present disclosure is also applicable to liquid discharge heads for which a piezoelectric method and various other liquid discharge methods are employed. Further, a so-called page-wide liquid discharge head having a length corresponding to a width of a recording medium is described as an example of the liquid discharge head according to the present example embodiment. However, the present disclosure is also applicable to a so-called serial liquid discharge head that performs recording while scanning a recording medium. Examples of the serial liquid discharge head include a liquid discharge head having a configuration in which a recording element substrate for black ink and a recording element substrate for each color ink are mounted. Not only this configuration, but also a configuration in which a head that includes several recording element substrates arranged so as to overlap discharge ports in a discharge port row direction and has a width shorter than that of a recording medium is prepared and the head is caused to scan the recording medium can be used.

The liquid discharge head according to the present example embodiment is mounted on a recording apparatus having a configuration in which a liquid, such as ink, is circulated between the liquid discharge head and a tank stored in a main body of the recording apparatus. However, the present disclosure is not limited to this configuration. It is possible to employ a configuration in which two tanks are provided on an upstream side and a downstream side of the liquid discharge head and ink is caused to flow from one of the tanks to the other one of the tanks, thereby circulating the ink only in the liquid discharge head. Further, it is also possible to employ a configuration in which only ink necessary for discharge is supplied from a tank without circulating the ink in the liquid discharge head.

Description of First Example Embodiment

Recording Apparatus

Figure 1:
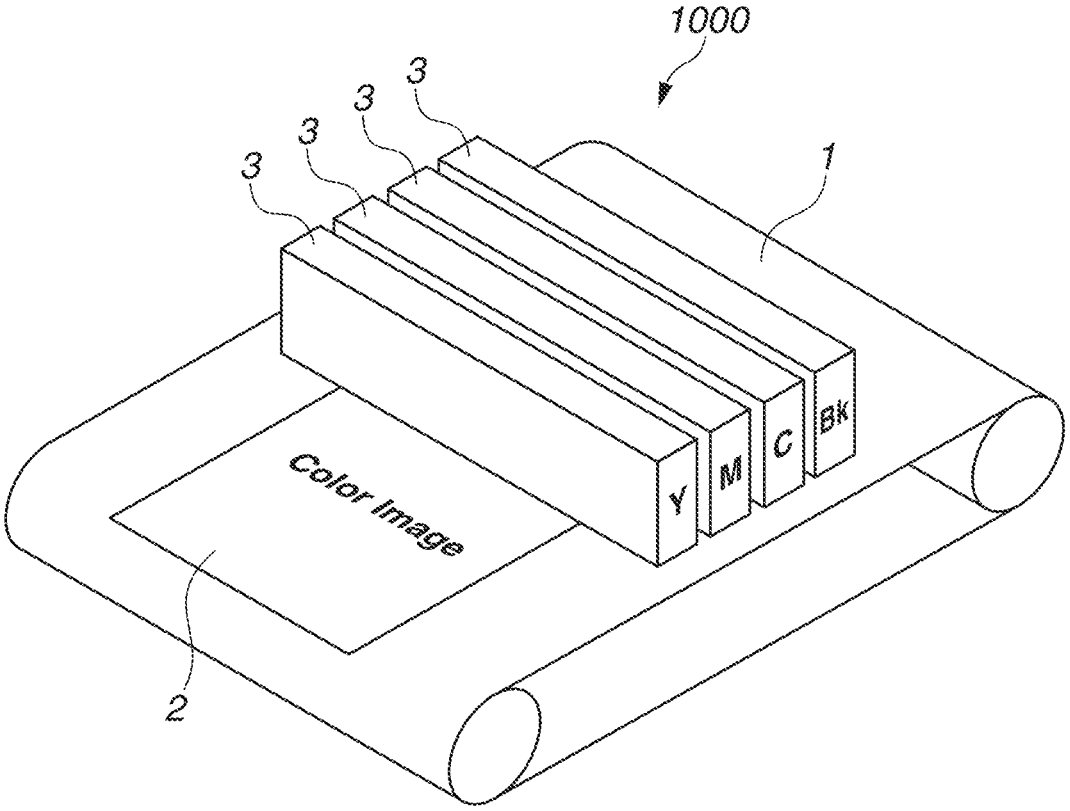
FIG. 1 is a schematic view illustrating an example recording apparatus.

An apparatus that is provided with a liquid discharge head according to an aspect of the present disclosure and discharges a liquid, in particular, an inkjet recording apparatus 1000 (hereinafter referred to as the recording apparatus) that discharges ink and performs recording will be described with reference to FIG. 1. FIG. 1 is a schematic view illustrating the recording apparatus 1000. The recording apparatus 1000 includes a conveying portion 1 that conveys a recording medium 2, and page-wide liquid discharge heads 3 that are arranged substantially perpendicular to a direction in which the recording medium 2 is conveyed. Four single-color liquid discharge heads 3 corresponding to respective ink colors of cyan (C), magenta (M), yellow (Y), and black (K), are arranged in parallel to thereby perform full-color printing on the recording medium 2. In the present example embodiment, the number of discharge port rows that can be used for one color is 20 (see FIG. 7A).

Accordingly, extremely high-speed recording can be achieved by performing recording while sorting recording data for a plurality of discharge port rows. Further, even if ink is not discharged from some of the discharge ports, ink is discharged from discharge ports in other rows, which are located at positions corresponding to the discharge ports in a conveying direction of the recording medium 2, in an interpolating manner, so that the reliability of ink discharge is enhanced and thus this configuration can be suitably used for commercial printing and the like. A supply system, a buffer tank 1003 (FIG. 2), and a main tank 1006 (FIG. 2) of the recording apparatus 1000 are connected to each liquid discharge head 3. Further, an electrical control portion for transmitting power and a discharge control signal to each liquid discharge head 3 is electrically connected to each liquid discharge head 3.

Example Circulation System

Figure 2:
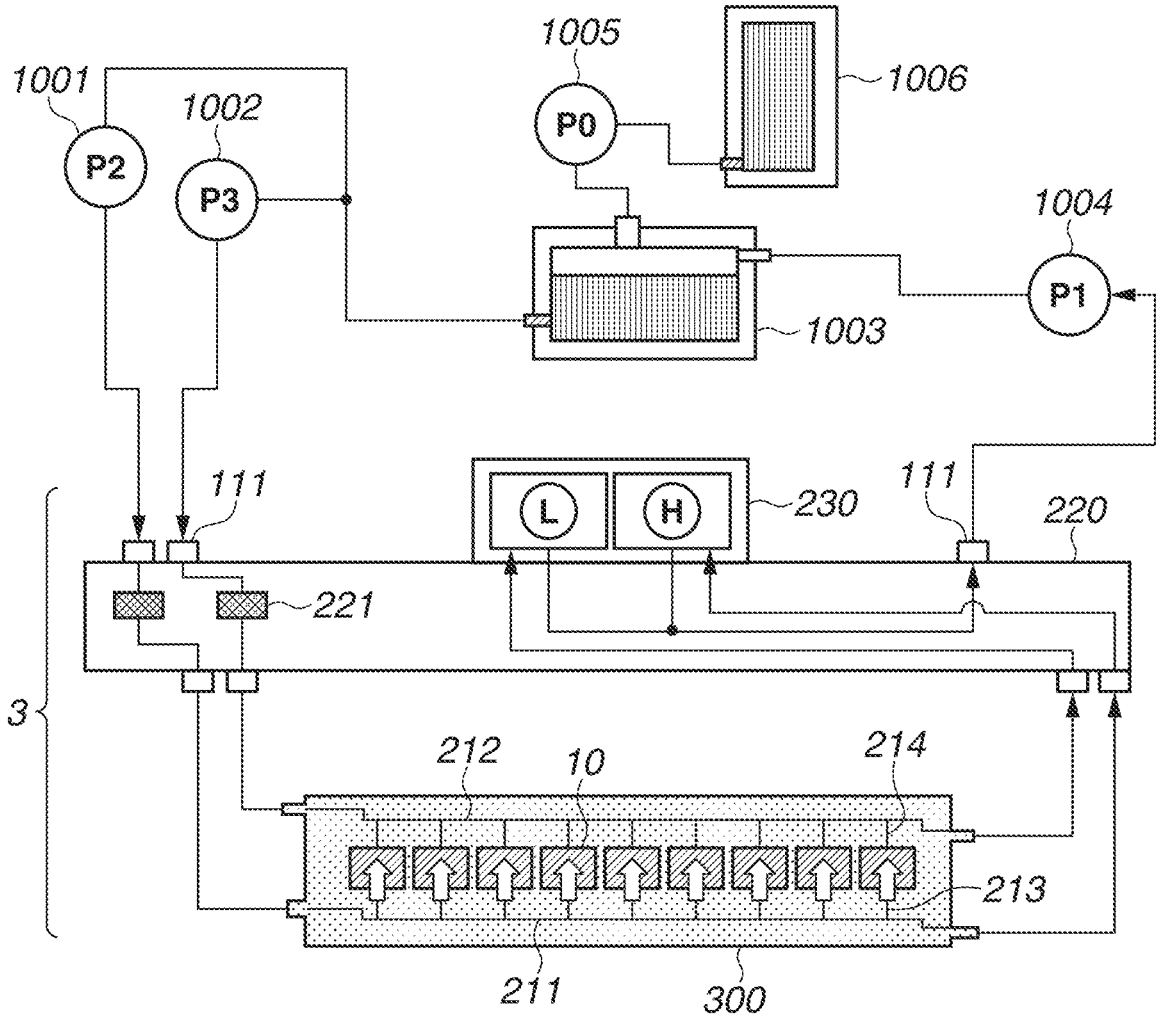
FIG. 2 is a schematic view illustrating an example circulation system of the recording apparatus.

A circulation system for the recording apparatus 1000 will be described with reference to FIG. 2. FIG. 2 is a schematic view illustrating a circulation path to be applied to the recording apparatus 1000 according to the present example embodiment. Each of two pressure adjustment mechanisms constituting a negative pressure control unit 230 is a mechanism (a mechanism component having the same operation as a so-called "back-pressure regulator") which controls a pressure on the upstream side relative to the negative pressure control unit 230 with a fluctuation within a certain range based on a desired set pressure. A second circulation pump 1004 operates as a negative pressure source for depressurization on the downstream side relative to the negative pressure control unit 230. A first circulation pump (high-pressure-side) 1001 and a first circulation pump (low-pressure-side) 1002 are arranged on the upstream side above the liquid discharge head 3, and the negative pressure control unit 230 is arranged on the downstream side above the liquid discharge head 3.

The negative pressure control unit 230 operates in such a manner that a pressure fluctuation on the upstream side relative to the negative pressure control unit 230 (i.e., a side where a liquid discharge unit 300 is located) can be stabilized within a certain range based on a preliminarily set pressure even when a flow rate fluctuates due to a change in the amount of discharge during recording by the liquid discharge head 3. As illustrated in FIG. 2, the downstream side relative to the negative pressure control unit 230 may be pressurized through a liquid supply unit 220 by the second circulation pump 1004. With this configuration, adverse effects of the water head pressure of the buffer tank 1003 above the liquid discharge head 3 can be suppressed, so that the number of options for the layout of the buffer tank 1003 in the liquid discharge apparatus 1000 can be increased. Instead of the second circulation pump 1004, for example, a water head tank arranged with a predetermined water head difference can also be applied to the negative pressure control unit 230.

As illustrated in FIG. 2, the negative pressure control unit 230 includes two pressure adjustment mechanisms to which different control pressures are set. Out of the two negative pressure adjustment mechanisms, a high-pressure-side negative pressure adjustment mechanism (denoted by "H" in FIG. 2) and a low-pressure-side negative pressure adjustment mechanism (denoted by "L" in FIG. 2) are each connected to a common supply path 211 and a common collecting channel 212, which are provided in the liquid discharge unit 300, via the inside of the liquid supply unit 220. The two negative pressure adjustment mechanisms set the pressure of the common supply channel 211 to be relatively higher than the pressure of the common collecting channel 212, thereby generating an ink flow from the common supply channel 211 toward the common collecting channel 212 through individual channels 213 and internal channels of recording element substrates 10.

Example Liquid Discharge Head

Figure 3A:
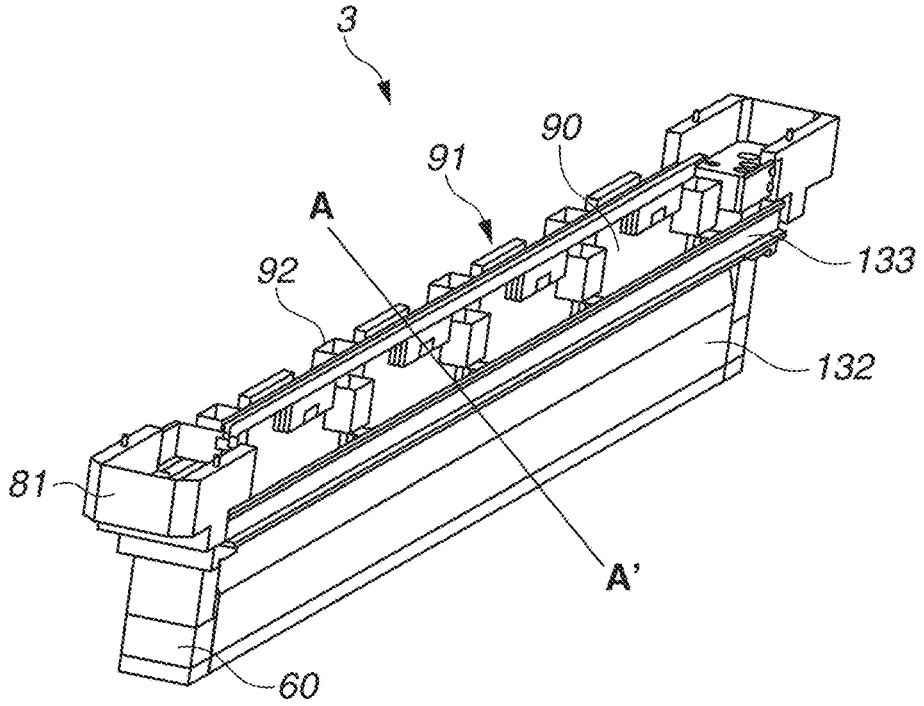
FIG. 3A is a perspective view illustrating an example liquid discharge head.
Figure 3B:
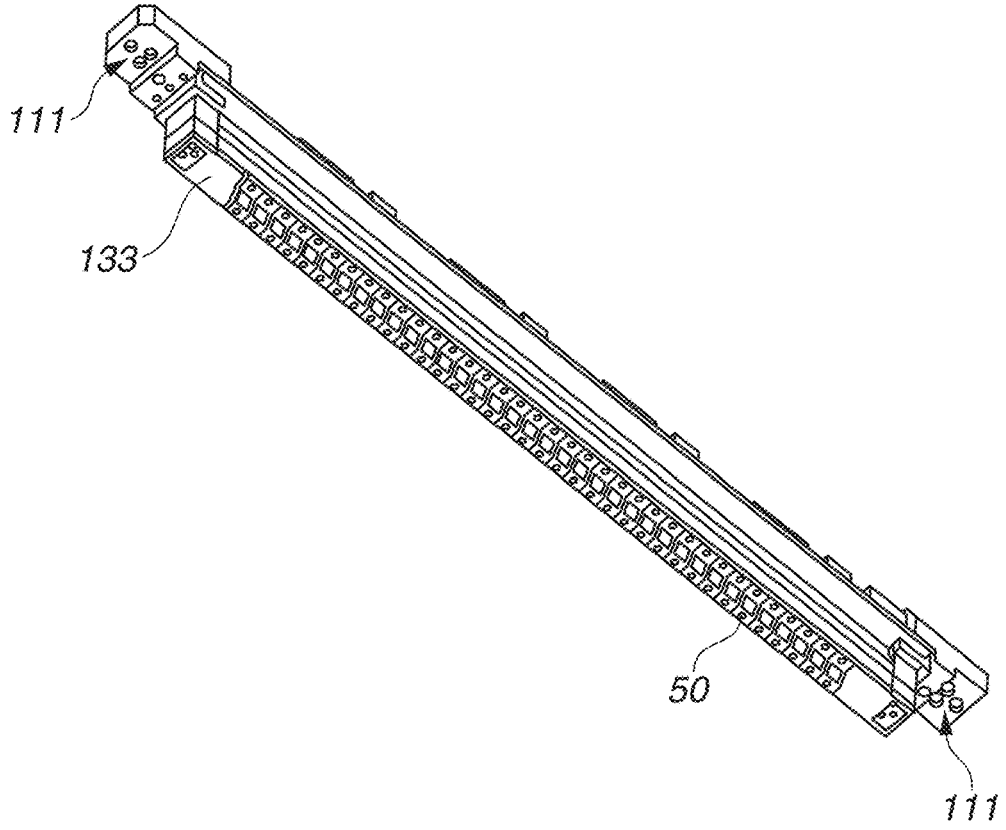
FIG. 3B is a perspective view illustrating the liquid discharge head.

The configuration of each liquid discharge head 3 will be described with reference to FIGS. 3A and 3B and FIG. 4. FIGS. 3A and 3B are perspective views each illustrating the liquid discharge head 3 according to the present example embodiment. In FIG. 3B, the illustration of each recording element substrate 10 is omitted, while first channel members 50 to be described below are illustrated in such a manner that the first channel members 50 can be seen. The liquid discharge head 3 is an inkjet page-wide recording head including 36 recording element substrates 10 which are arranged linearly in a longitudinal direction of the liquid discharge head 3. The liquid discharge head 3 includes signal input terminals 91 and power supply terminals 92 which are electrically connected to each other via plate-like electric wiring boards 90. The signal input terminals 91 and the power supply terminals 92 are electrically connected to the control portion of the recording apparatus 1000 (FIG. 1) and each supply recording element substrate 10 with a discharge drive signal and power necessary for discharge. Wires are aggregated by electrical circuits in each electric wiring board 90, thereby reducing the number of the signal output terminals 91 and the power supply terminals 92 to be smaller than the number of the element substrates 10. Thus, only a small number of electrical connecting portions that need to be detached during assembly of the liquid discharge head 3 to the recording apparatus 1000, or during replacement of the liquid discharge head 3 are provided.

Plate-like protective members 132 are placed on both sides of the liquid discharge head 3 so as to sandwich each electric wiring board 90. With this configuration, each electric wiring board 90 can be protected against damage from the outside due to static electricity, so-called ink mist, and the like. Further, the protective members 132 are fixed to a second channel member 60 and the like, thereby preventing a recording liquid from climbing up from a gap between the protective members 132 and the second channel member 60. Accordingly, the protective members 132 play the role of protecting flexible printed circuit boards 40 each having a low liquid resistance against the recording liquid. As a material for the protective members 132, wide variety of materials, such as resin and metal, can be selected. In particular, in the case of using metal having electrical conductivity as the protective members 132, each electric wiring member 90 can be protected against electrical noise such as static electricity.

Figure 4:
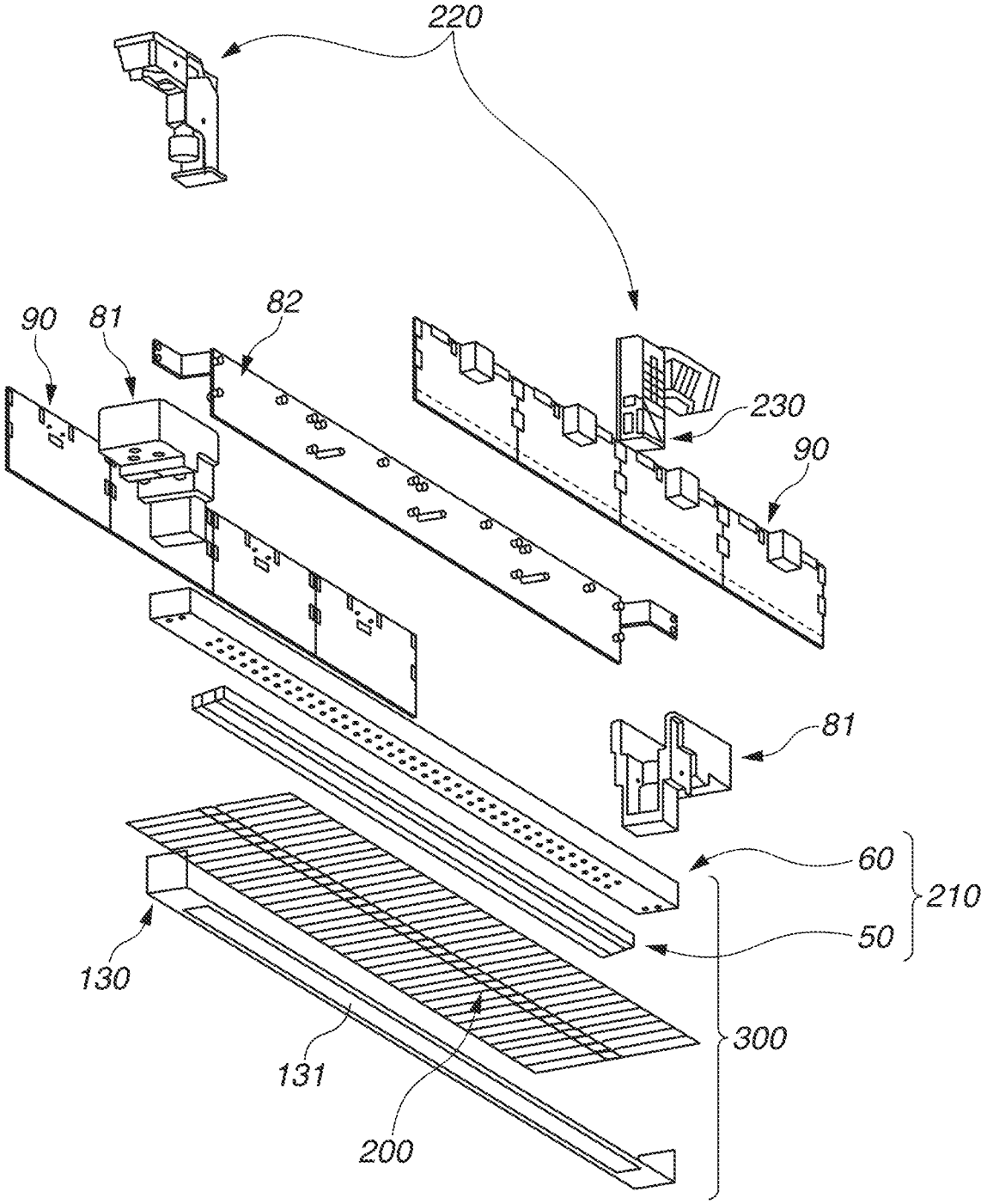
FIG. 4 is an exploded view illustrating the liquid discharge head.

FIG. 4 is an exploded view illustrating the liquid discharge head 3. Components or units constituting the liquid discharge head 3 illustrated in FIG. 4 are divided for each function. The rigidity of the liquid discharge head 3 is secured by the second channel member 60 included in the liquid discharge unit 300. Liquid discharge unit support portions 81 respectively are connected to both sides of the second channel member 60 and are mechanically coupled with a carriage of the recording apparatus 1000, to thereby position the liquid discharge head 3. The liquid supply unit 220 including the negative pressure control unit 230 and each electric wiring board 90 coupled to an electric wiring board support portion 82 are coupled to the liquid discharge unit support portions 81. A filter (not illustrated) is incorporated in each of the two liquid supply units 220.

As illustrated in FIG. 4, the high-pressure-side and low-pressure-side pressure adjustment mechanisms constituting the negative pressure control unit 230 are placed at both ends in the longitudinal direction of the liquid discharge head 3. In this case, a liquid flow in the common supply channel 211 (FIG. 2) extending in the longitudinal direction of the liquid discharge head 3 is opposed to a liquid flow in the common collecting channel 212 (FIG. 2). With this configuration, heat exchange between the common supply channel 211 and the common collecting channel 212 is facilitated and the difference between the temperature in the common supply channel 211 and the temperature in the common collecting channel 212 is reduced. Accordingly, the temperature difference is less likely to occur between the recording element substrates 10, which is advantageous in that recording unevenness due to the temperature difference is less likely to occur.

Figure 6A:
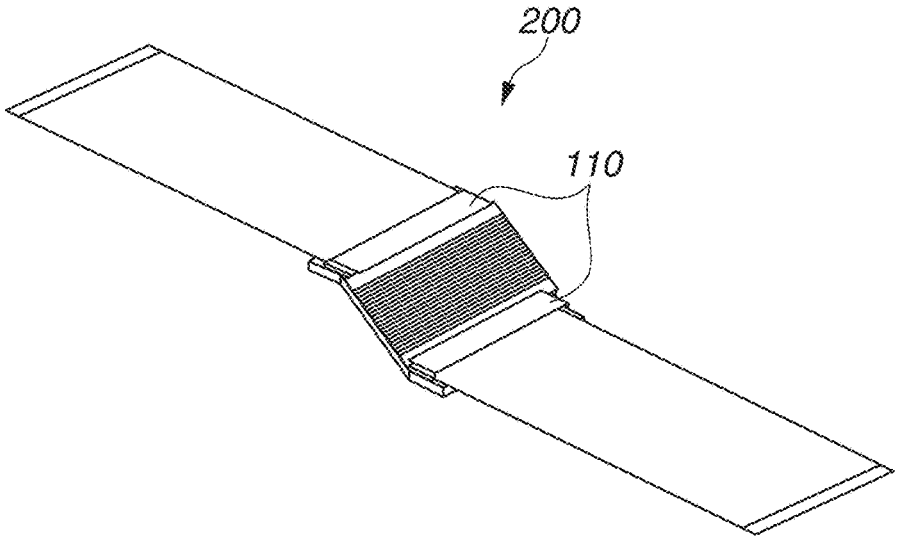
FIG. 6A is a perspective view illustrating the discharge module.
Figure 6B:
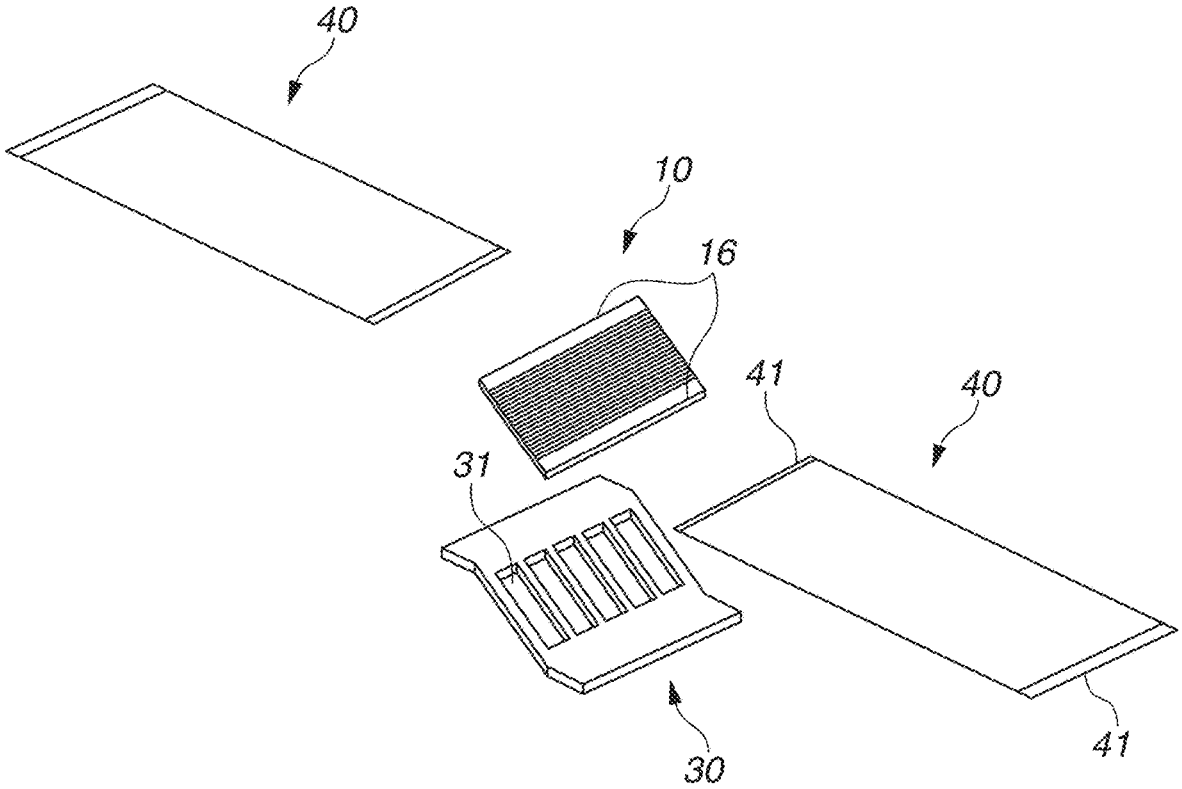
FIG. 6B is an exploded view illustrating the discharge module.

Next, a channel member 210 of the liquid discharge unit 300 will be described in detail. As illustrated in FIG. 4, the channel member 210 has a configuration in which the first channel member 50 and the second channel member 60 are stacked and liquid supplied from the liquid supply unit 220 is distributed to a discharge module 200 (FIGS. 6A and 6B). The discharge module 200 will be described in detail below. The channel member 210 also functions as a channel member for returning the liquid that circulates from the discharge module 200 to the liquid supply unit 220. The second channel member 60 of the channel member 210 is a channel member in which the common supply channel 211 and the common collecting channel 212 are formed and has a function for securing mainly the rigidity of the liquid discharge head 3. Therefore, it is preferable that as a material for the second channel member 60, a material having a sufficient corrosion resistance to a liquid and a high mechanical strength is used. Specifically, Steel Use Stainless (SUS), titanium (Ti), alumina, or the like may be used. Further, two or more first channel members 50 and two or more second channel members 60 may be stacked.

Example Channel Member

Figure 5A:
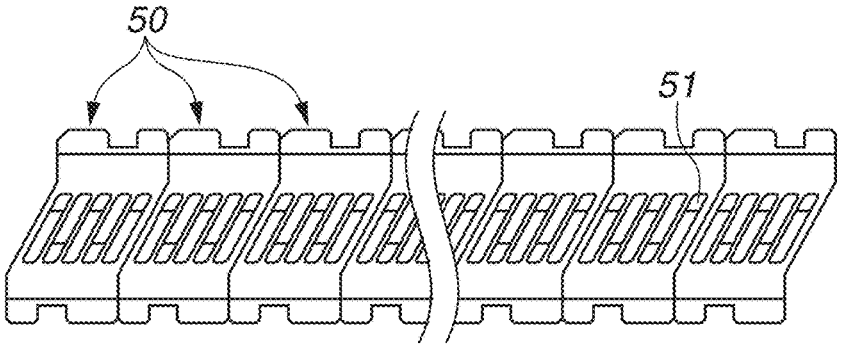
FIG. 5A illustrates a surface of each first channel member on which a discharge module is placed.
Figure 5B:
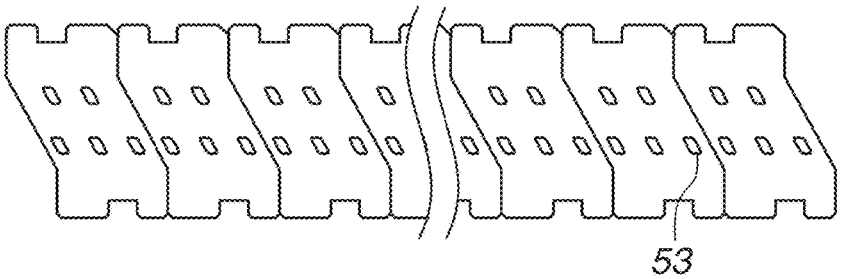
FIG. 5B illustrates a surface of each first channel member that contacts a second channel member.
Figure 5C:
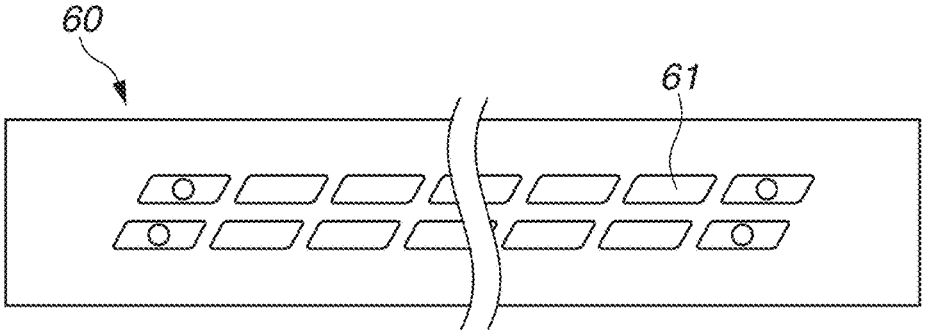
FIG. 5C illustrates a surface of the second channel member that contacts each first channel member.
Figure 5D:
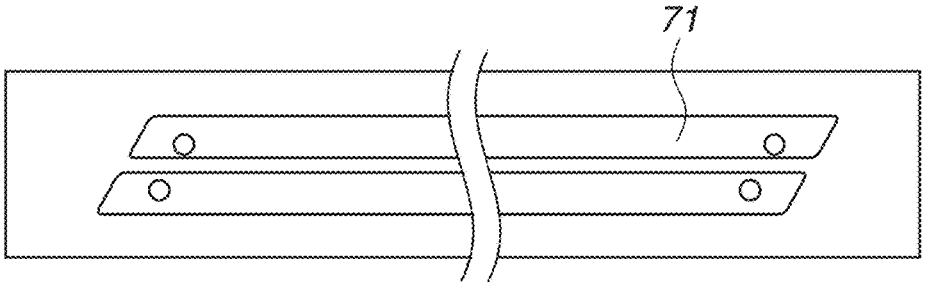
FIG. 5D illustrates a section of a central portion in a thickness direction of the second channel member.
Figure 5E:
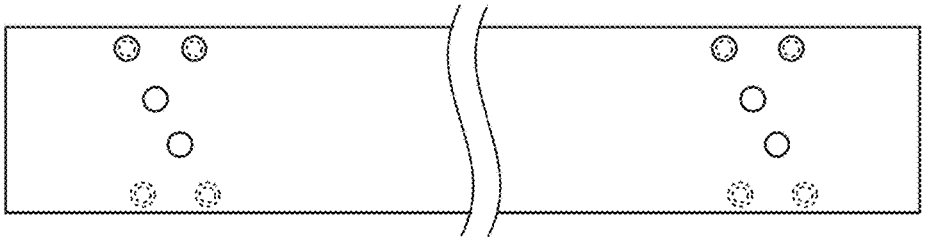
FIG. 5E illustrates a surface that contacts a liquid supply unit, of the second channel member.

The channel member 210 will be described with reference to FIGS. 5A to 5E. FIG. 5A illustrates a surface of the first channel member 50 on which the discharge module 200 is placed. FIG. 5B illustrates a back surface of each first channel member 50 that comes into contact with the second channel member 60. FIG. 5C illustrates a surface of the second channel member 60 that comes into contact with each first channel member 50. FIG. 5D illustrates a section of a central portion in a thickness direction of the second channel member 60. FIG. 5E illustrates a surface of the second channel member 60 that comes into contact with the liquid supply unit 220.

The first channel members 50 are an array of a plurality of adjacent members corresponding to each discharge module 200. The first channel members 50 having such a divided structure allow a plurality of discharge modules 200 to be arrayed so as to correspond to the length of the corresponding liquid discharging head 3, and are particularly suitable for a relatively large liquid discharge head 3 that is used with a recording medium having, for example, a B2 size or greater. As illustrated in FIG. 5A, communication ports 51 in the first channel members 50 fluidically communicate with the discharge module 200. As illustrated in FIG. 5B, individual communication ports 53 in the first channel members 50 fluidically communicate with communication ports 61 in the second channel member 60. One of common channel grooves 71 in the second channel member 60 corresponds to the common supply channel 211 illustrated in FIG. 2, and the other one of the common channel grooves 71 corresponds to the common collecting channel 212. The common channel grooves 71 are each supplied with liquid from one end to the other end of each common channel groove 71 along the longitudinal direction of the liquid discharge head 3. The longitudinal direction of the liquid flowing through the common supply channel 211 is opposite to the longitudinal direction of the liquid flowing through the common collecting channel 212.

Example Discharge Module

The discharge module 200 will be described with reference to FIGS. 6A and 6B. FIG. 6A is a perspective view illustrating a single discharge module 200. FIG. 6B is an exploded view illustrating the discharge module 200. A plurality of terminals 16 is arranged on both sides of the recording element substrate 10 (at long sides of the recording element substrate 10) along the direction in which a plurality of discharge ports are arranged, and two flexible printed circuit boards 40 that are electrically connected to the plurality of terminals 16 are arranged for a single recording element substrate 10. This is because 20 discharge port rows are provided on the recording element substrate 10 and the number of wires is increased based on the number of the discharge port rows. The recording element substrate 10 is supported on a support member 30 including openings 31.

Example Structure of Recording Element Substrate

Figure 7A:
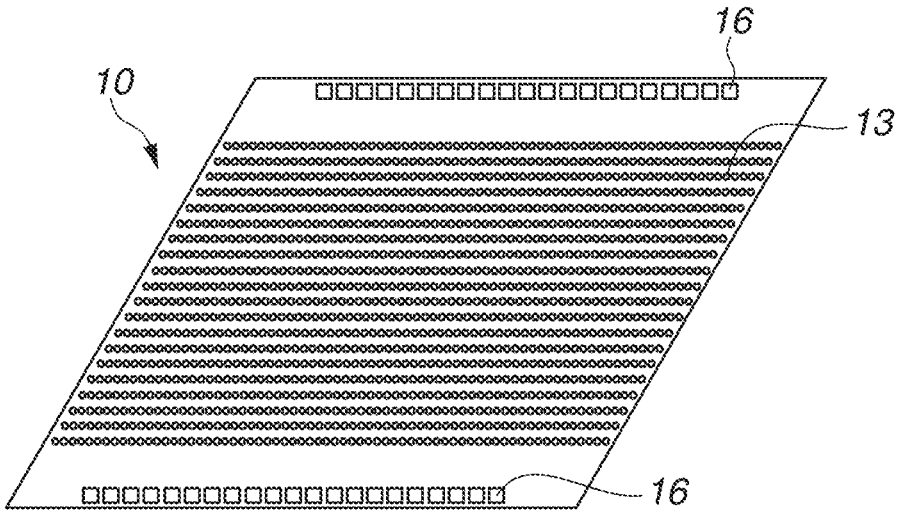
FIG. 7A illustrates a surface of a recording element substrate on which discharge ports are arranged.
Figure 7B:
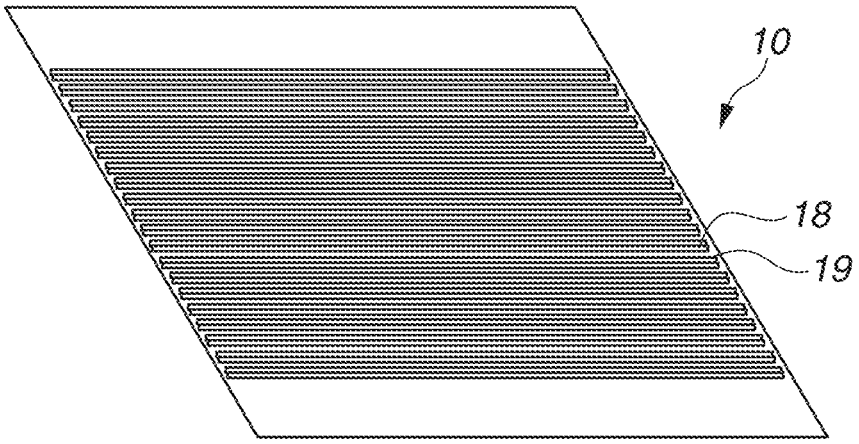
FIG. 7B illustrates a surface opposite to the surface of the recording element substrate on which the discharge ports are arranged.

The recording element substrate 10 will be described with reference to FIGS. 7A to 9. FIG. 7A is a schematic view illustrating a surface of the recording element substrate 10 on which discharge ports 13 are arranged. FIG. 7B is a schematic view illustrating a surface opposite to the surface of the recording element substrate 10 on which the discharge ports 13 are arranged. As illustrated in FIG. 7B, liquid supply paths 18 and liquid collecting paths 19 which communicate with the common supply channel 211 (FIG. 2) and the common collecting channel 212 (FIG. 2) are formed on the recording element substrate 10. Thus, a path for circulating the liquid between the recording element substrate 10 and the recording apparatus 1000 is established.

Figure 8:
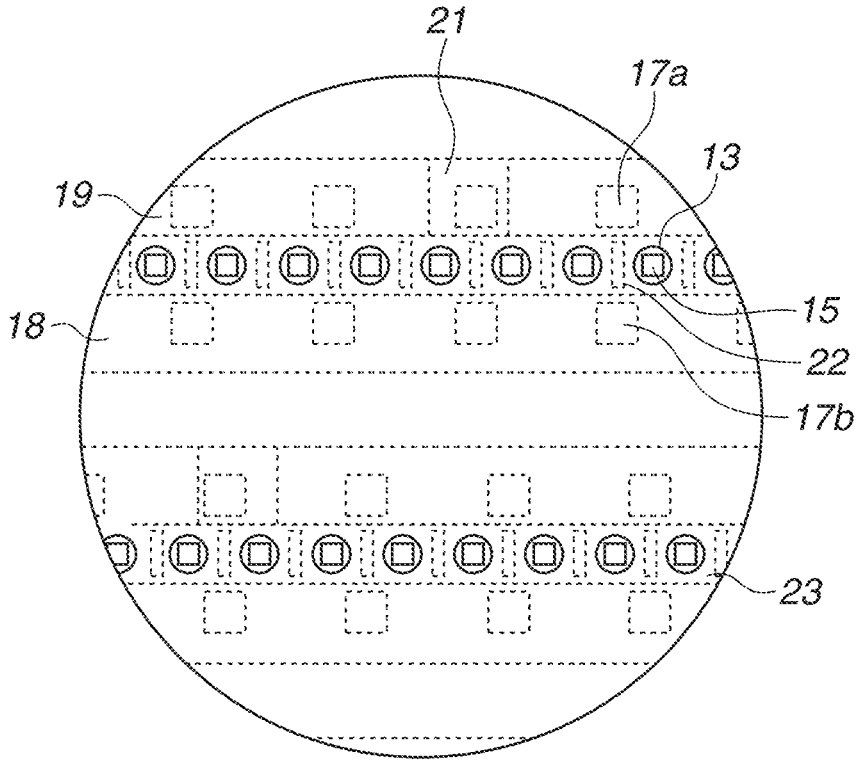
FIG. 8 is an enlarged view illustrating the recording element substrate.

FIG. 8 is an enlarged view of the element substrate 10 illustrated in FIG. 7B. As illustrated in FIG. 8, energy generating elements that provide the liquid with energy necessary for discharging the liquid from the discharge ports 13 are provided at respective positions corresponding to the discharge ports 13. Energy generating elements 15 are, for example, heaters for heating a liquid. The liquid is heated to generate air bubbles in the liquid, and the liquid is discharged by foam pressure.

Pressure chambers 23 including the respective energy generating elements 15 are partitioned by partitions 22. The energy generating elements 15 are electrically connected to the terminals 16, which are illustrated in FIG. 7A, by electrical wiring (not illustrated) provided on the recording element substrate 10. The liquid passes through the pressure chambers 23 from supply ports 17*a* and flows into collecting ports 17*b*. With this configuration, the liquid is evaporated in the vicinity of the discharge ports 13 and the liquid with a large viscosity can be caused to flow to the downstream side, thereby suppressing an increase in the viscosity of the liquid in the pressure chambers 23.

Example Arrangement of Recording Element Substrates

Figure 9:
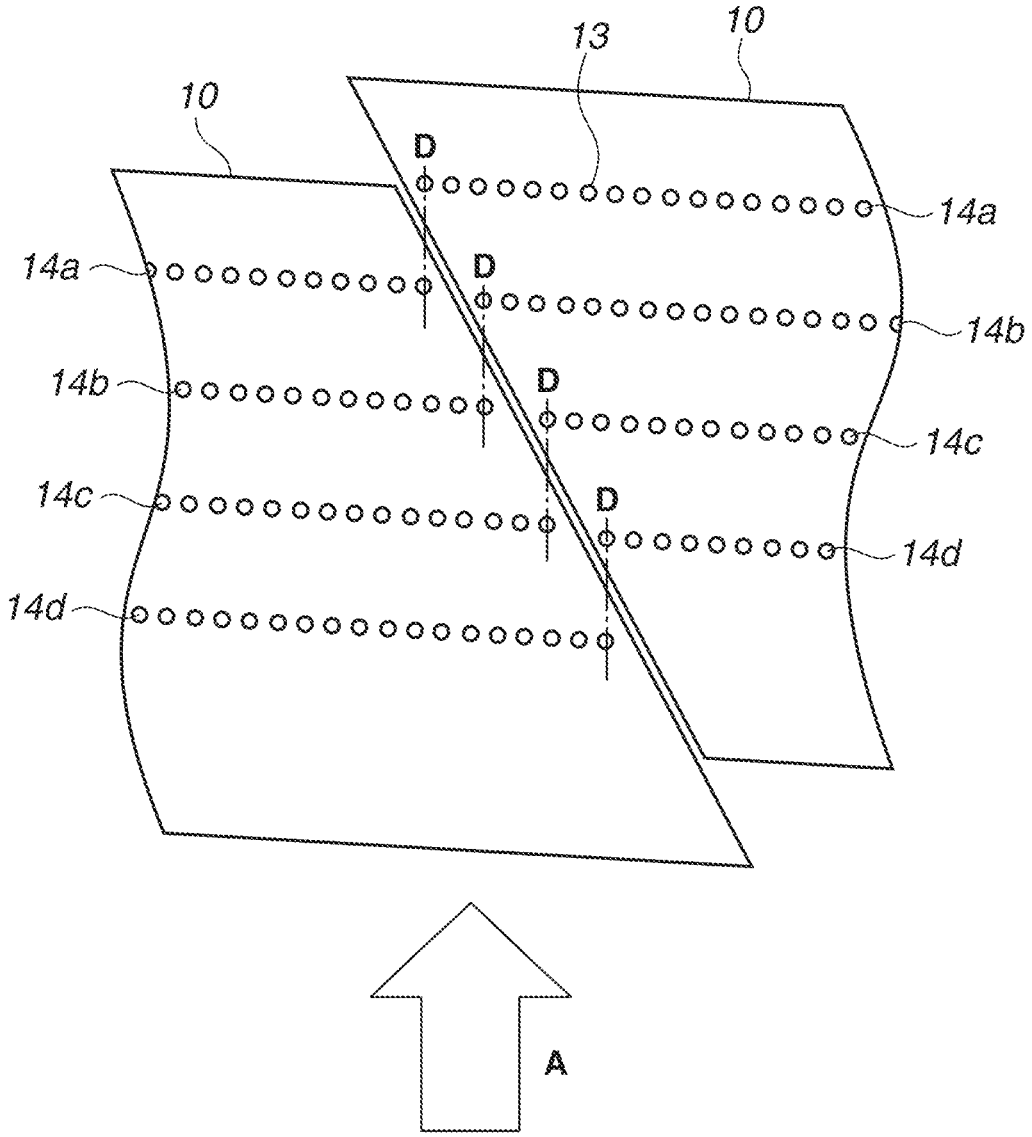
FIG. 9 is an enlarged view illustrating two recording element substrates adjacent to each other.

An adjacent portion where two recording element substrates 10 are adjacent to each other will be described with reference to FIG. 9. FIG. 9 is a partially enlarged schematic view illustrating the adjacent portion where the two recording element substrates 10 are adjacent to each other. As illustrated in FIGs. 7A and 7B, in the present example embodiment, substantially parallelogram-shaped recording element substrates 10 are used. As illustrated in FIG. 9, the recording element substrate 10 illustrated on the right side of FIG. 9 is arranged on the downstream side in a conveying direction A of the recording medium relative to the recording element substrate 10 illustrated on the left side of FIG. 9. By arranging the recording element substrates 10 in this manner, as viewed along the direction A, a discharge port row 14*d* illustrated on the right side of FIG. 9 and a discharge port row 14*d* illustrated on the left side of FIG. 9 are arranged so as to overlap at least one of the discharge ports 13. Referring to FIG. 9, two discharge ports on a D-line overlap each other. With this arrangement, even if the position of each recording element substrate 10 slightly deviates from a predetermined position, black streaks or white spots in a printed image can be made less conspicuous by drive control of overlapping discharge ports.

Not only when the plurality of recording element substrates 10 is arranged linearly (in line), but also when the plurality of recording element substrates 10 is arranged in a staggered manner, black streaks or white spots at a connecting portion between the recording element substrates 10 can be suppressed. In the present example embodiment, the main face of the recording element substrate 10 has a parallelogram shape, but the present disclosure is not limited to this. For example, the use of recording element substrates having a rectangular shape, a trapezoidal shape, or other shapes can be preferably applied.

(Example Configuration of Electrical Connection)

Figure 10:
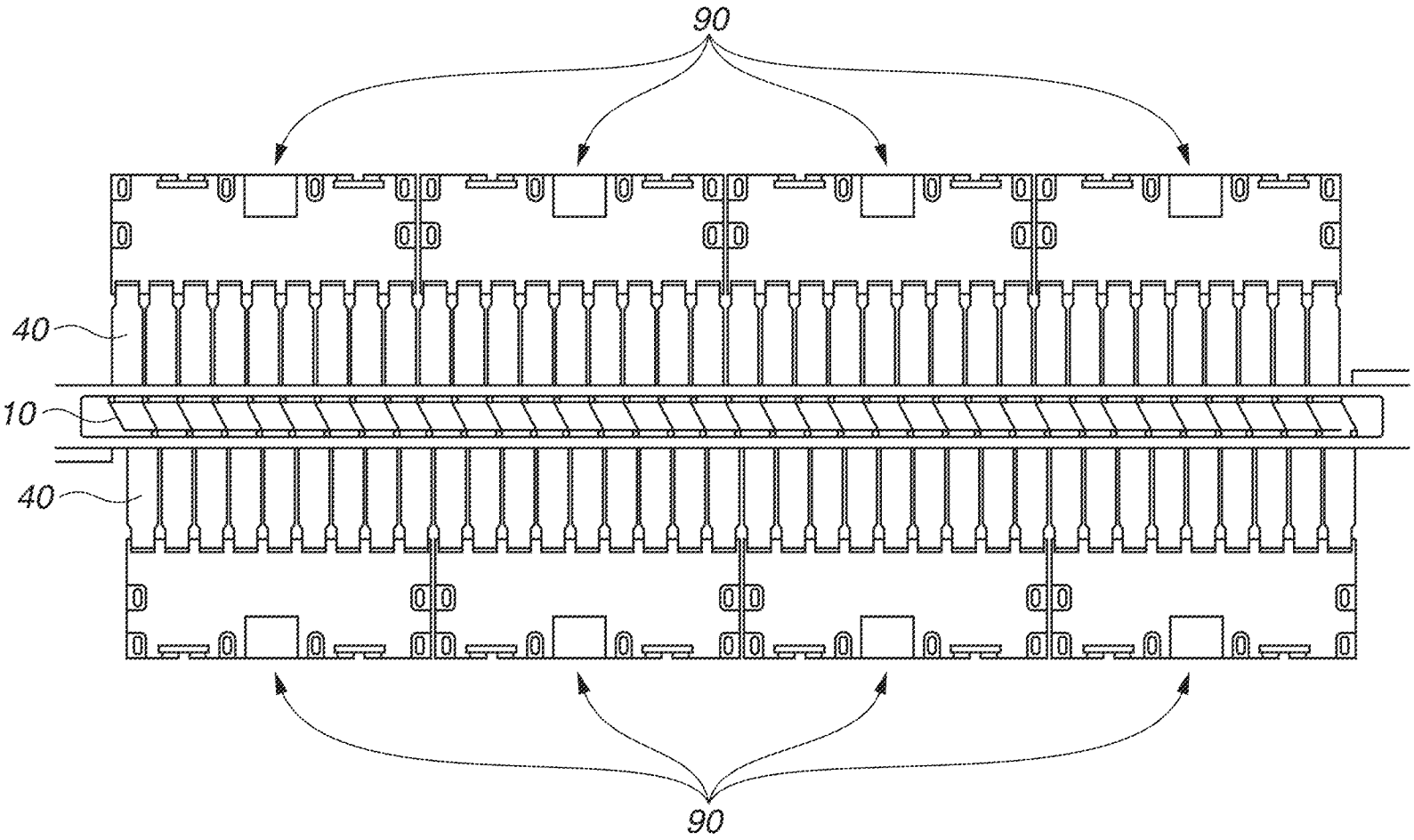
FIG. 10 is a schematic view illustrating an example electrical connection.

FIG. 10 illustrates a configuration for connecting the recording element substrates 10, the flexible printed circuit boards 40, and the electric wiring boards 90. For convenience of explanation, FIG. 10 illustrates a state where the flexible printed circuit boards 40 are straightened. The plurality of flexible printed circuit boards 40 is electrically connected to the plurality of recording element substrates 10. Further, the plurality of electric wiring boards 90 is electrically connected to the plurality of flexible printed circuit boards 40. The number of the electric wiring boards 90 is not limited to the number (four) illustrated in FIG. 10. Each of the electric wiring boards 90 is connected to one or more flexible printed circuit boards 40. With this electrical connection, power and a drive signal which are required for driving the energy generating elements 15 are transmitted from the electric wiring boards 90 to the recording element substrates 10.

Example Bent Portion of Protective Member

Figure 11:
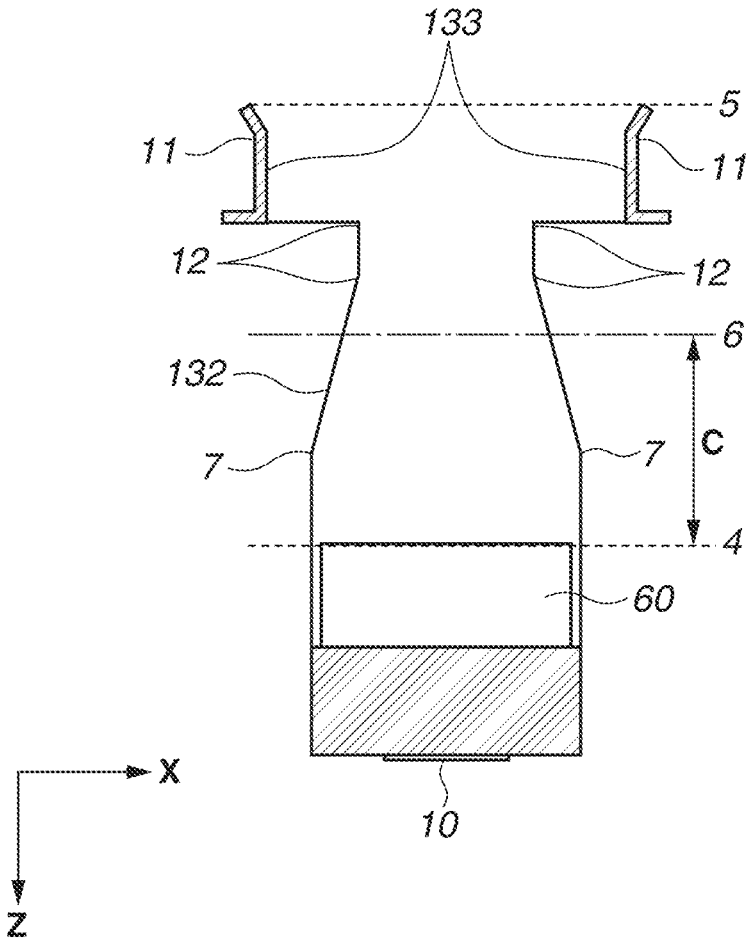
FIG. 11 is a sectional view illustrating the liquid discharge head.

The shape of each protective member 132, which is a characteristic portion of the present disclosure, will be described with reference to FIG. 11. FIG. 11 is a schematic view illustrating a section taken along a line A-A' illustrated in FIG. 3A. As illustrated in FIG. 11, the protective member 132 includes bent portions 7 which are bent in a transverse direction X of the liquid discharge head 3 in a first area C (above an upper end (indicated by a broken line 4) of the second channel member 60 and below a midpoint (indicated by a broken line 6) of a line segment connecting the upper end 4 and an upper end (indicated by a broken line 5) of the protective member 132). Thus, the provision of the first bent portions 7 in the vicinity of the second channel member 60 makes it possible to reduce deformation due to thermal expansion of the protective member 132, in particular, deformation at the bent portions 7 in an inter-sheet direction Z, and to suppress deformation in the inter-sheet direction Z of the second channel member 60. An angle formed between each first bent portion 7 and a surface perpendicular to a discharge port surface on which the discharge ports are arranged is, for example, less than or equal to 90 degrees.

Figures 12A, 12B, 12C:
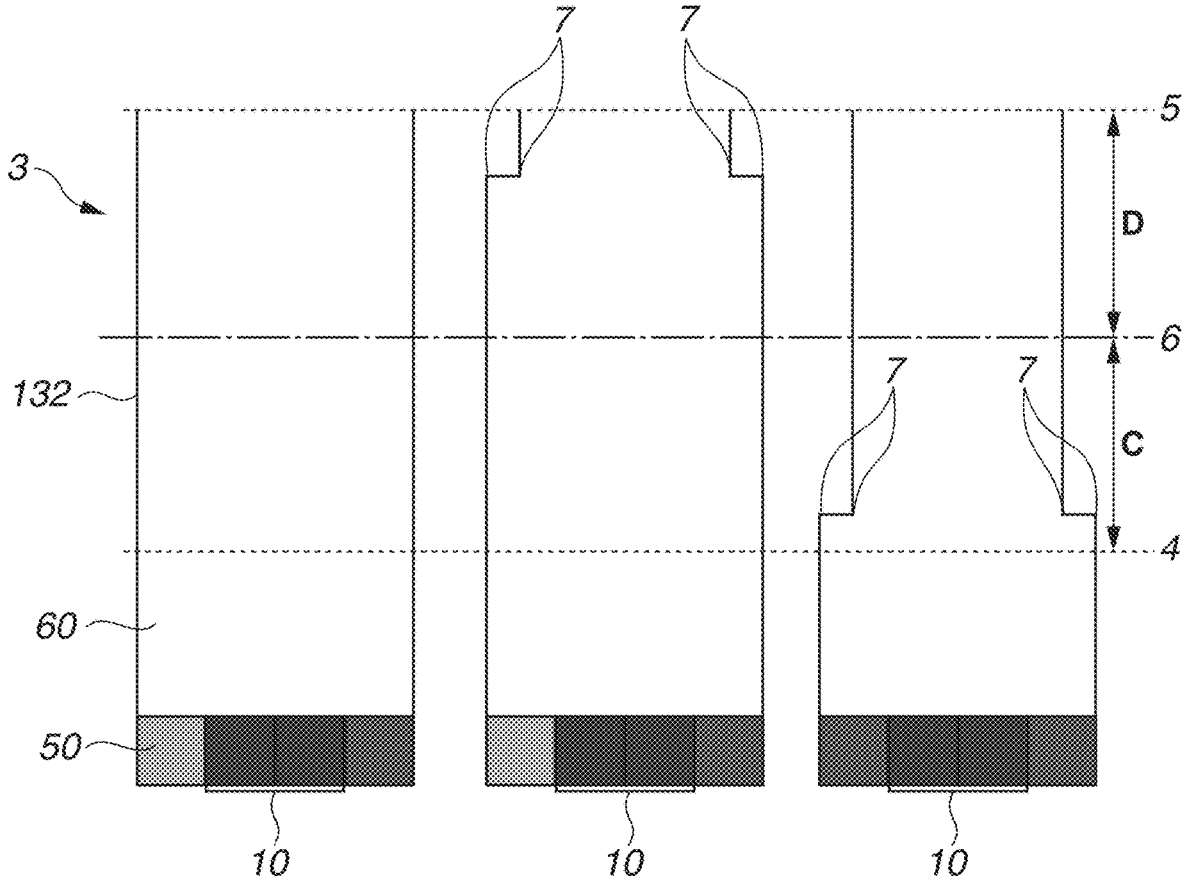
FIG. 12A is a schematic view illustrating a liquid discharge head when a protective member is not provided with first bent portions.
FIG. 12B is a schematic view illustrating the liquid discharge head when the first bent portions are provided at an upper portion of the protective member.
FIG. 12C is a schematic view illustrating the liquid discharge head when the first bent portions are provided at a lower portion of the protective member.

Next, advantages effects of the first bent portions 7 of the protective member 132 will be described with reference to FIGS. 12A, 12B, and 12C and FIG. 14. FIG. 12A is a schematic view illustrating the liquid discharge head 3 when the protective member 132 is not provided with the first bent portions 7. FIG. 12B is a schematic view illustrating the liquid discharge head 3 when the first bent portions 7 provided at an upper portion (second area D) of the protective member 132. FIG. 12C is a schematic view illustrating the liquid discharge head 3 when the first bent portions 7 are provided at a lower portion (first area C) of the protective member 132.

Figure 13A:
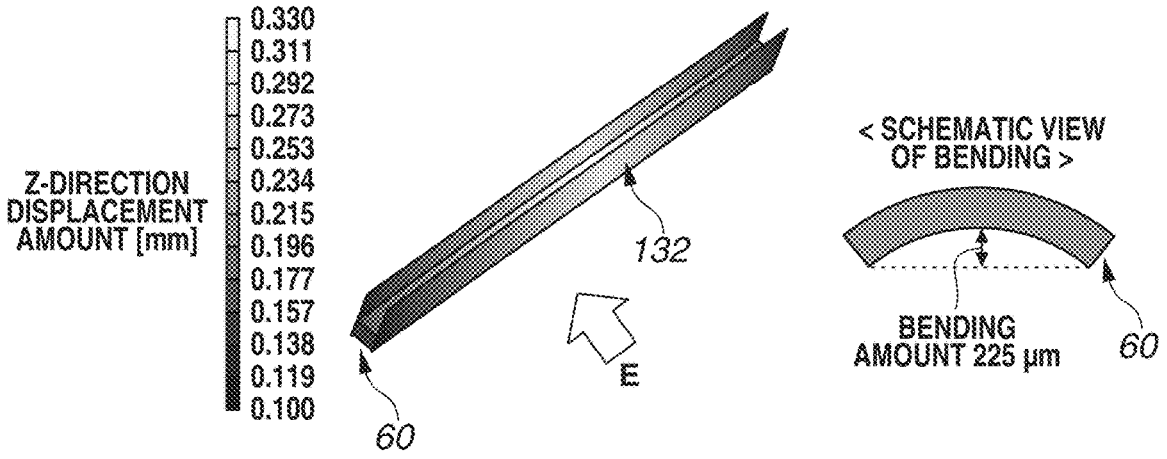
FIG. 13A illustrates a result of a simulation related to the amount of bending of the protective member illustrated in FIG. 12A.
Figure 13B:
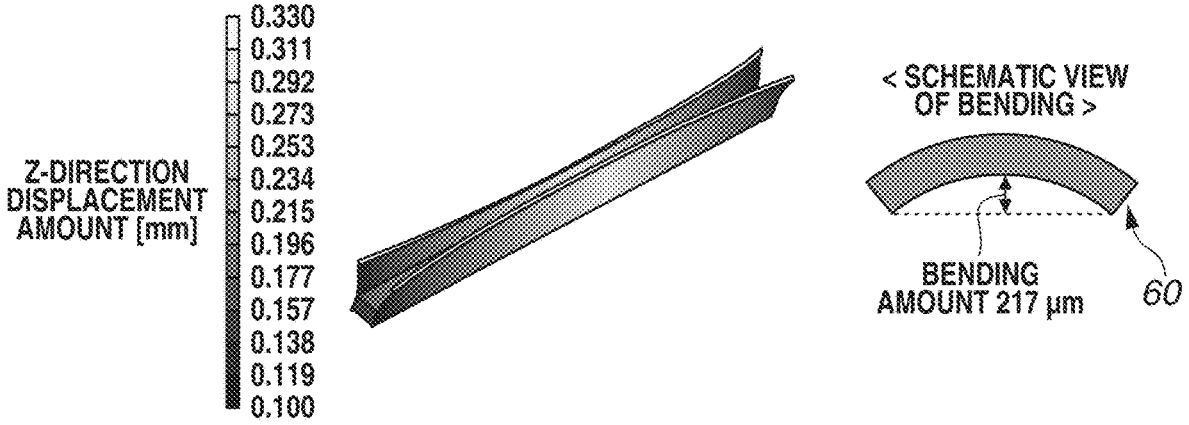
FIG. 13B illustrates a result of a simulation related to the amount of bending of the protective member illustrated in FIG. 12B.
Figure 13C:
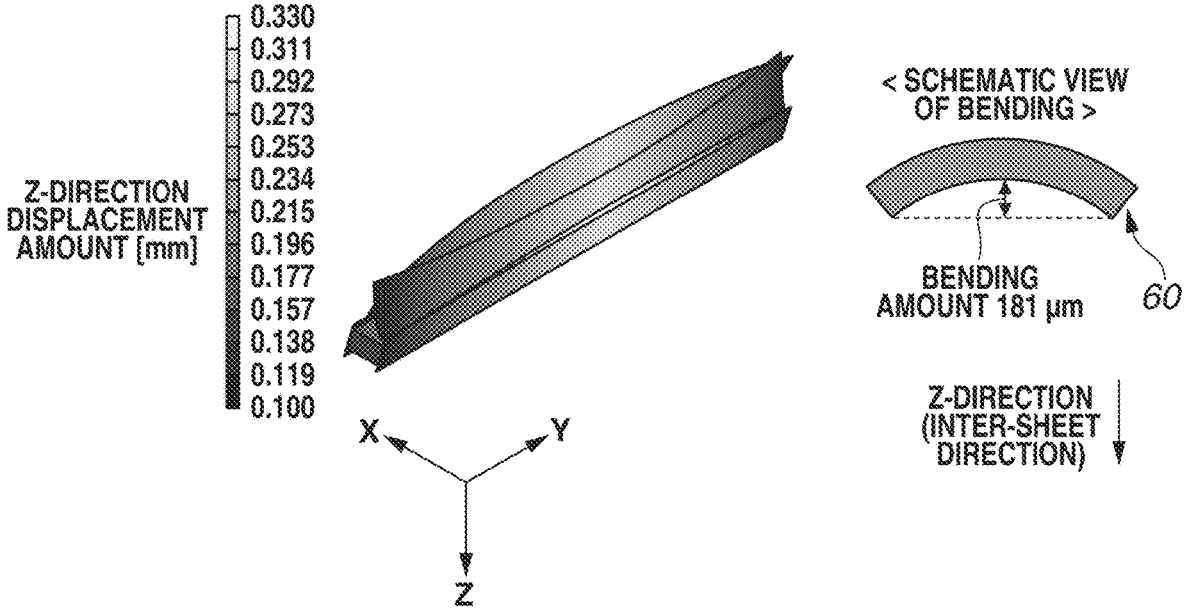
FIG. 13C illustrates a result of a simulation related to the amount of bending of the protective member illustrated in FIG. 12C.

FIGS. 13A, 13B, and 13C each illustrate a state where the second channel member 60 is deformed when the protective members 132 are fixed to the second channel member 60 and the entire liquid discharge head 3 in an initial state of 25° C. is heated to 60° C. FIGS. 13A, 13B, and 13C each illustrate a result of a simulation performed when the first channel members 50 are each made of resin, the second channel member 60 is made of alumina, and the protective members 132 are each made of stainless (SUS 304). This is a simulation model simplified for convenience of explanation, and the configuration according to the present example embodiment may include members other than the simulation model. The figure on the right side of each of FIGS. 13A, 13B, and 13C illustrates the amount of bending of the second channel member 60 in the inter-sheet direction Z when the second channel member 60 is viewed from a side surface (direction E illustrated in the figure on the left side of FIG. 13A).

FIG. 13A illustrates a simulation result in the protective member 132 illustrated in FIG. 12A. FIG. 13B illustrates a simulation result in the protective member 132 illustrated in FIG. 12B. FIG. 13C illustrates a simulation result in the protective member 132 illustrated in FIG. 12C. The simulation results illustrated in FIGS. 13A, 13B, and 13C show that the amount of bending of the protective member 132 in the configuration (FIG. 13C) in which the first bent portions 7 are provided at a lower portion is minimum.

It seems that such a result is obtained for the following reasons. First, as illustrated in FIGS. 13A, 13B, and 13C, in a case where there is no bent portions 7 as illustrated in FIG. 13A, the protective member 132 is little deformed in the transverse direction X of the liquid discharge head 3. On the other hand, in a case where the bent portions 7 are provided as illustrated in FIGS. 13B and 13C, the protective member 132 is also deformed in the transverse direction X. In other words, it seems that deformation due to thermal expansion of the protective member 132 is facilitated in the transverse direction by the first bent portions 7 and the amount of deformation in the inter-sheet direction is suppressed by the amount corresponding to the deformation. The connecting portion of the protective member 132 corresponds to the second channel member 60. Accordingly, in the case where the first bent portions 7 are provided at positions closer to the second channel member 60, which is the connecting portion, as illustrated in FIG. 13C, bending in the inter-sheet direction is minimized.

In this manner, the first bent portions 7 are provided on the protective member 132, thereby suppressing deformation (bending) in the inter-sheet direction (Z-direction) of the liquid discharge head 3. More preferably, assuming that a side where the recording element substrate 10 is located is defined as a lower side and a side where the second channel member 60 is located is defined as an upper side, the protective member 132 includes the first bent portions 7 above the upper end 4 of the second channel member 60 and below the midpoint 6 of the line segment connecting the upper end 4 of the second channel member 60 and the upper end 5 of the protective member 132.

Figure 14:
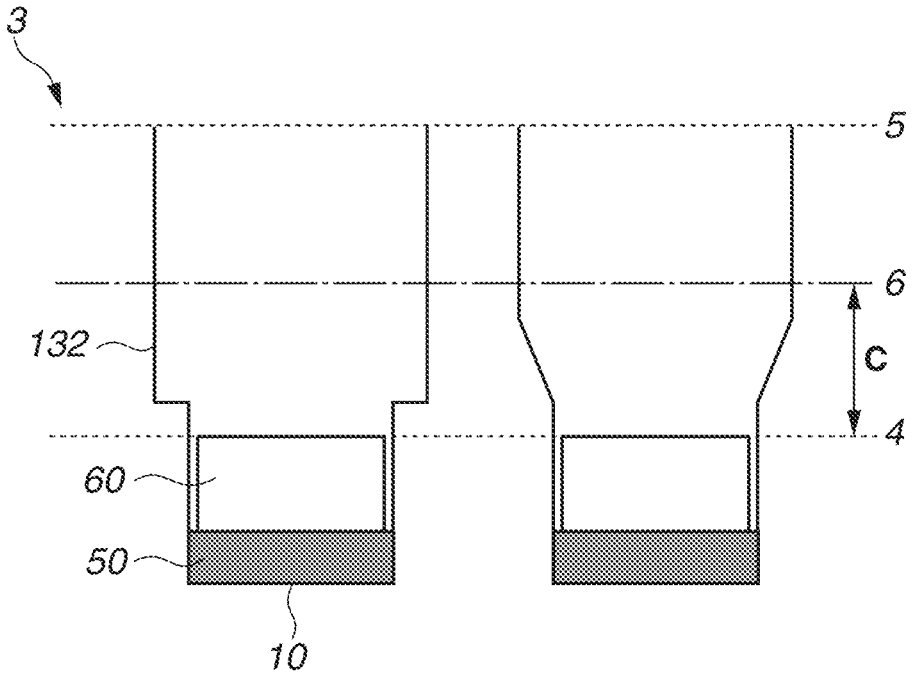
FIG. 14 illustrates a modified example of the protective member.

FIG. 14 illustrates another preferred modified example of the protective member 132 according to the present example embodiment. The example embodiment described above illustrates the configuration including the first bent portions 7 that are bent toward the inside of the liquid discharge head 3. However, the first bent portions 7 may be bent toward the outside of the liquid discharge head 3 as illustrated in FIG. 14. For example, FIG. 14 illustrates that the first bent portions 7 are continuously formed along the longitudinal direction of the liquid discharge head 3, but need not necessarily be continuously formed. Alternatively, a configuration in which the first bent portions 7 are formed in at least a part of an area in the longitudinal direction, a configuration in which the first bent portions 7 are provided intermittently in the longitudinal direction, or a configuration in which the shape of the first bent portions 7 varies in the longitudinal direction may be employed.

As illustrated in FIG. 11, the protective member 132 may have a configuration in which each of second bent portions 12 is provided on a side where a corresponding reinforcing portion 133 to be described in detail below is located. Specifically, the second bent portions 12 are provided in an area above the midpoint 6 of the protective member 132. The reinforcing portions 133 have a high rigidity and have a great effect on bending of the liquid discharge head 3 due to thermal deformation. Accordingly, the provision of the second bent portions 12 makes it possible to correct the thermal deformation of the reinforcing portions 133 in the transverse direction X.

Example Reinforcing Member of Protective Member

Figure 15:
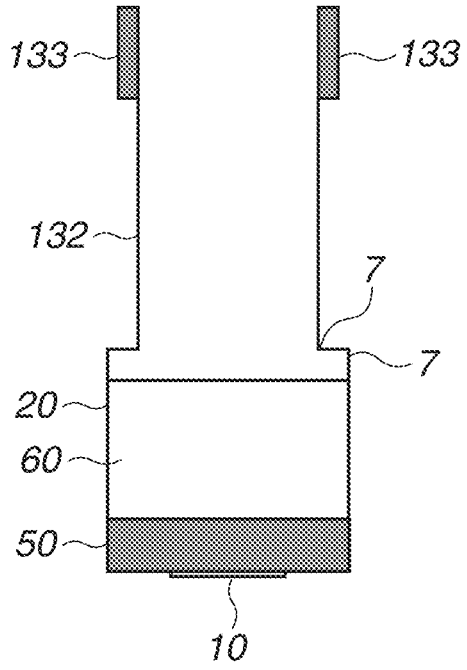
FIG. 15 is a schematic view illustrating the liquid discharge head provided with reinforcing portions.
Figures 16A, 16B, 16C, 16D:
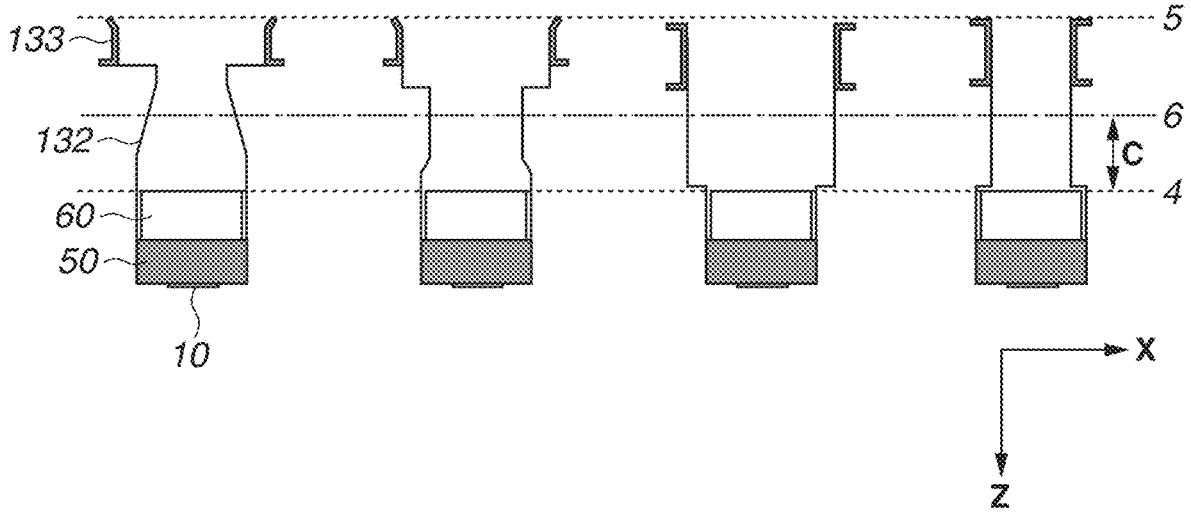
FIGS. 16A to 16D illustrate modified examples of the protective member and the reinforcing portions.

The reinforcing portions 133 provided on the protective member 132 will be described with reference to FIG. 15. FIG. 15 is a schematic view illustrating the liquid discharge head 3 when the reinforcing portions 133 are provided. As the thickness of the protective member 132 decreases, deformation (bending) of the liquid discharge head 3 is less likely to occur. Accordingly, the protective member 132 having a smaller thickness is desirably used in terms of suppressing the deformation of the liquid discharge head 3. On the other hand, if the protective member 132 is extremely thin, the required rigidity of the protective member 132 cannot be obtained, which causes an issue that the protective member 132 is deformed or damaged.

Accordingly, as illustrated in FIG. 15, the plate thickness of the main body of the protective member 132 is reduced and the reinforcing portions 133 having a large plate thickness are provided in a portion apart from a joint area 20 to be joined with the channel members. With this configuration, a certain level or more of rigidity can be secured even when the thickness of the main body of the protective member 132 is small, and thus the protection of the electric wiring board 90 can be achieved. The thickness of the main body of the protective member 132 is preferably less than or equal to 1 mm, and more preferably, less than or equal to 0.3 mm. The thickness of each reinforcing portion 133 is 2 mm. The reinforcing portions 133 are fixed to the liquid discharge unit support portions 81 by screwing or the like, to thereby fix the protective member 132.

The reinforcing portions 133 may be provided in the following order. That is, the second channel member 60, the first bent portions 7, and the reinforcing portions 133 may be formed in this order from the recording element substrate 10. Alternatively, the second channel member 60, the reinforcing portions 133, and the first bent portions 7 may be formed in this order from the recording element substrate 10. However, as illustrated in FIG. 15, it is preferable to provide the reinforcing portions 133 in the vicinity of the upper end of the protective member 132. When the reinforcing portions 133 are provided in a portion apart from the joint area 20 between the protective member 132 and the second channel member 60, bending can be reduced by the first bent portion 7 even if the reinforcing portions 133 cause thermal deformation and are deformed in the inter-sheet direction.

Next, the shape of the reinforcing portion 133 will be described with reference to FIG. 11 and FIGS. 16A to 16D. As the shape of the reinforcing portions 133, it is preferable that the reinforcing portions 133 includes respective bent portions 11 which are bent in the transverse direction X as illustrated in FIG. 11, like the protective member 132. The provision of the bent portions 11 makes it possible to promote the deformation in the transverse direction X due to heat from the reinforcing portions 133 and suppress the deformation in the inter-sheet direction Z. Next, FIGS. 16A to 16D illustrate modified examples of the protective member 132 and the reinforcing portions 133. The shapes of the protective member 132 and the reinforcing portions 133 according to the present disclosure are not limited to these examples. Any shape can be employed as long as the expansion or contraction due to heat can be facilitated in the transverse direction X and bending in the inter-sheet direction Z can be suppressed.

Example Fixation of Protective Member

Figure 17A:
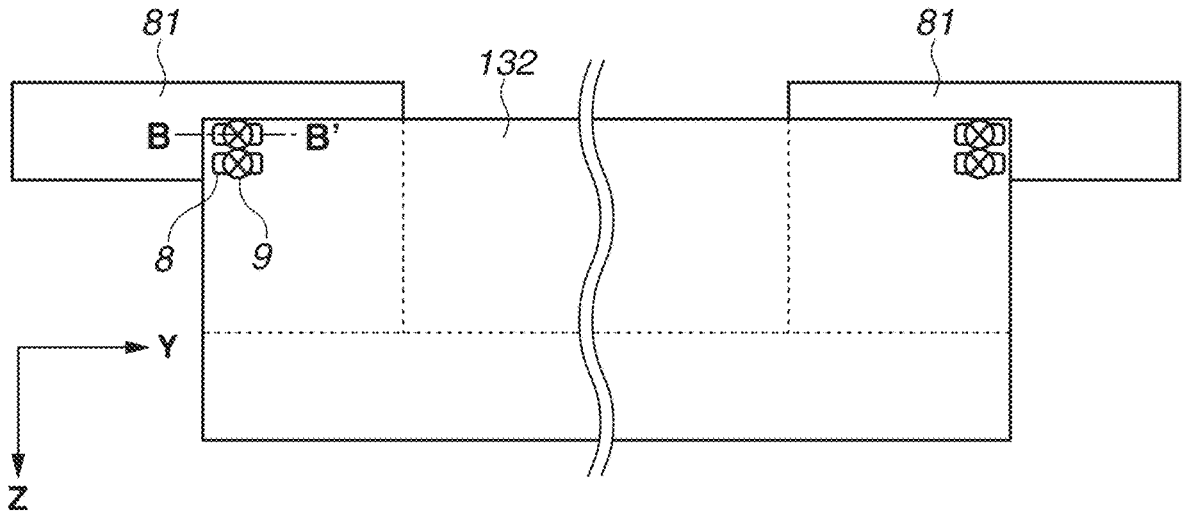
FIG. 17A is a schematic view illustrating a case where the protective member and liquid discharge unit support portions are connected with stepped screws.
Figure 17B:
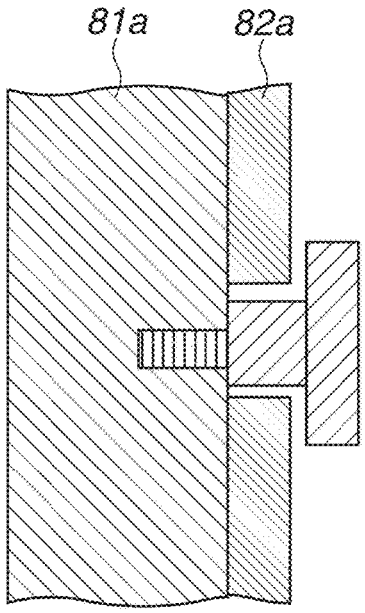
FIG. 17B is a schematic view illustrating a section taken along a line B-B' illustrated in FIG. 17A.

A connection between the protective member 132 and the liquid discharge unit support portions 81 will be described with reference to FIGS. 17A and 17B. FIG. 17A is a schematic view illustrating a case where the protective member 132 and the liquid discharge unit support portions 81 are connected with stepped screws. FIG. 17B is a schematic view illustrating a section taken along a line B-B' illustrated in FIG. 17A. As illustrated in FIGS. 17A and 17B, stepped screws or the like are desirably used to fix the protective member 132 to the liquid discharge unit support portions 81 such that the protective member 132 can move in the longitudinal direction Y of the liquid discharge head 3. As illustrated in FIG. 17B, a gap formed between the screw and each member enables the protective member 132 to relatively move in the longitudinal direction Y. If the liquid discharge unit support portions 81 and the protective member 132 are completely fixed, the protective member 132 having a linear expansion coefficient different from that of the liquid discharge head 3 may cause the liquid discharge head 3 to be greatly deformed through the liquid discharge unit support portions 81 during contraction or expansion due to a temperature change.

Figure 18A:
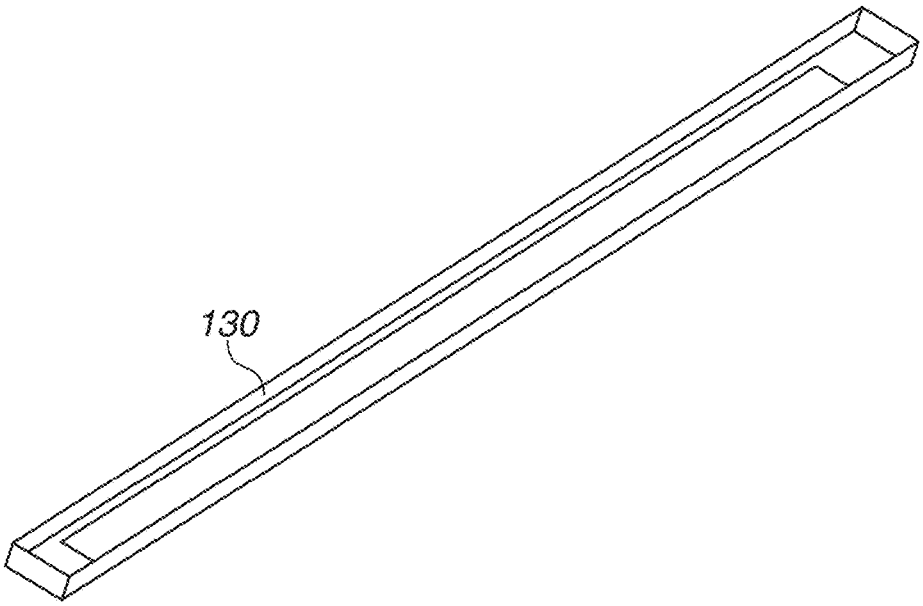
FIG. 18A is a perspective view illustrating a fixing member.
Figure 18B:
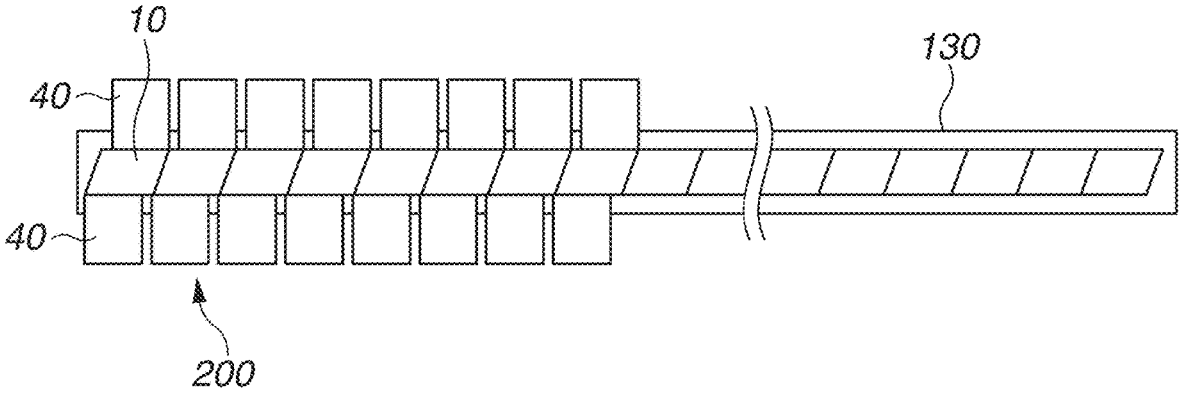
FIG. 18B is a schematic view illustrating the discharge module and the fixing member joined with the discharge module as viewed from a back side of a discharge port surface.

A second example embodiment will be described with reference to FIG. 3B, FIGS. 18A and 18B, and Table 1. Descriptions of components of the second example embodiment that are similar to those of the first example embodiment are omitted. The present example embodiment is characterized in that a fixing member 130 is provided on the liquid discharge head 3. FIG. 18A is a perspective view illustrating the fixing member 130. FIG. 18B is a schematic view illustrating the discharge module 200 and the fixing member 130 joined with the discharge module 200 as viewed from a back side of the discharge port surface. As illustrated in FIG. 3B, the fixing member 130 is attached on the surface side of the channel member 60 on which the recording element substrate 10 is supported.

The fixing member 130 includes an opening formed at a central portion of the fixing member 130 so as not to interfere with discharging of a liquid. The fixing member 130 is directly fixed to at least the first channel member 50 by a joining material or the like, or is indirectly fixed to the first channel member 50 by being joined with a flexible substrate that is, for example, joined with the first channel member 50. More preferably, if a discharge liquid enters a gap between the protective member 132 and the fixing member 130, the discharge liquid may damage the flexible printed circuit boards 40. For this reason, the fixing member 130 is joined with the protective member 132.

Next, effects of the fixing member 130 and whether to join the protective member 132 with the channel member will be described with reference to Table 1.

TABLE 1

| | Fixing member 130 is not provided | Fixing member 130 is provided (Condition 1) | Fixing member 130 is provided (Condition 2) |
|---|---|---|---|
| Adhesive portion of protective member 132 | Second channel member 60 | Fixing member 130 and Second channel member 60 | Fixing member 130 |
| Bending amount of head | +181 μm | +80 μm | −17 μm |

+: bent toward opposite side of recording medium
−: bent toward recording medium Table 1 illustrates the amount of bending obtained when the fixing member 130 is added to the above-described simulation (FIGS. 13A, 13B, and 13C) and the simulation is performed in two cases, i.e., in a case where the protective member 132 is joined with a side surface of the second channel member 60 and a side surface of the fixing member 130 (Condition 1), and in a case where the protective member 132 is joined with a side surface of the fixing member 130 (Condition 2). Like in FIGS. 13A, 13B, and 13C, Table 1 illustrates the amount of bending of the liquid discharge head 3 in the inter-sheet direction Z when the liquid discharge head 3 in the initial state of 25° C. is changed to 60° C. The simulation is performed assuming that the protective member 132 has a shape in which bent portions are provided on the side where the second channel member 60 is located, which is effective for suppressing bending of the liquid discharge head 3 according to the second example embodiment. Like the protective member 132, the fixing member 130 is made of stainless (SUS 304), the first channel member 50 is made of resin, and the second channel member 60 is made of alumina.

The results illustrated in Table 1 show that the provision of the fixing member 130 makes it possible to reduce bending of the liquid discharge head 3 in each of Condition 1 and Condition 2, as compared with a case where the fixing member 130 is not provided. This is because the protective member 132 and the fixing member 130 each having a linear expansion coefficient relatively larger than that of the second channel member 60 are arranged in a vertical direction of the second channel member 60. Specifically, when the temperature of the liquid discharge head 3 is increased, the protective member 132 causes the liquid discharge head 3 to be bent in the direction opposite to the direction of the recording medium, and the fixing member 130 causes the liquid discharge head 3 to be bent in the direction of the recording medium, so that the operations of the protective member 132 and the fixing member 130 are cancelled out. Accordingly, the deformation of the liquid discharge head 3 in the inter-sheet direction is suppressed. Further, in the example embodiments described above, the protective member 132 (SUS 304) and the fixing member 130 (SUS 304) are made of materials having a linear expansion coefficient larger than that of the second channel member 60 (alumina). However, the materials are not limited to these examples. The protective member 132 and the fixing member 130 may be made of materials having a linear expansion coefficient smaller than that of the second channel member 60. This is because the effect of cancelling out the amount of bending due to a difference in a deformation direction can be obtained. As long as the above-described relationships can be satisfied, the protective member 132 and the fixing member 130 may be made of different materials, or may be formed of materials other than metal.

Further, as seen from Table 1, when protective member 132 is joined only with the fixing member 130, the amount of bending can be further reduced. It seems to be because, when the protective member 132 is joined with the second channel member 60 through the fixing member 130, instead of being directly joined with the second channel member 60, the operation that allows the protective member 132 to cause the liquid discharge head 3 to project in the direction opposite to the direction of the recording medium (to be recessed toward the recording medium) is indirect, which results in reducing the deformation.

Other Example Embodiments

Figure 19A:
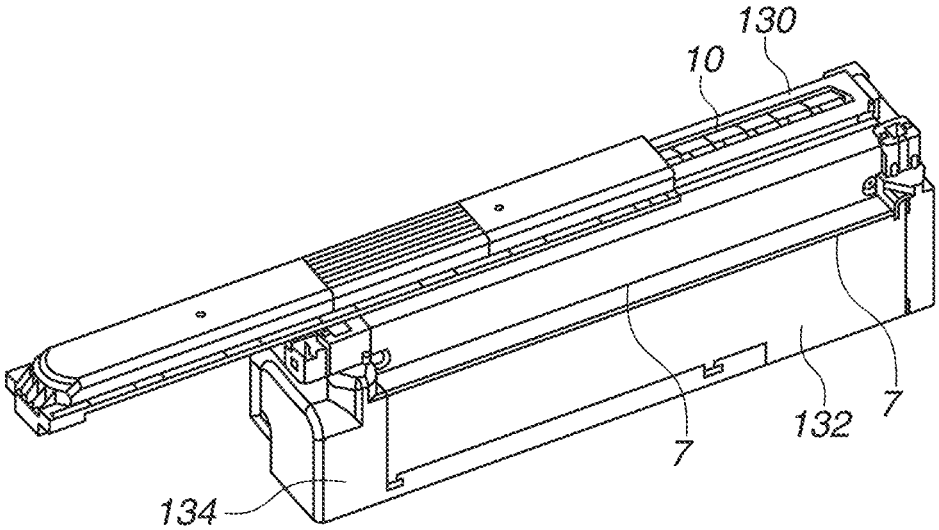
FIG. 19A is a schematic view illustrating a liquid discharge head according to another example embodiment.
Figure 19B:
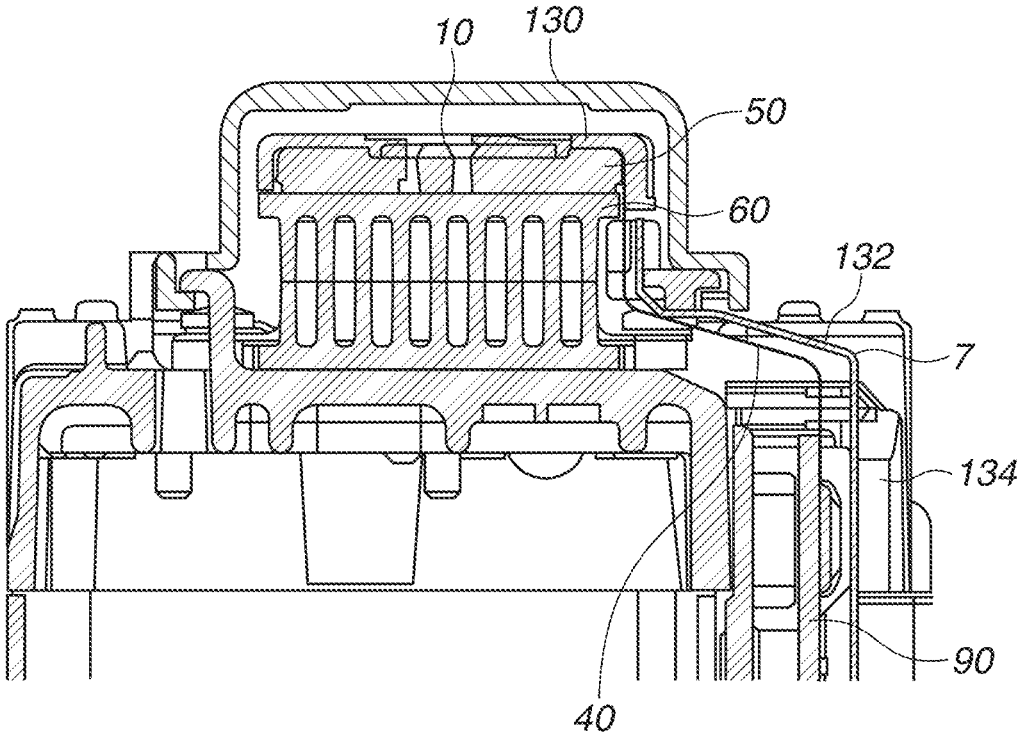
FIG. 19B is a sectional view of the liquid discharge head illustrated in FIG. 19A.

In the first and second example embodiments, the protective members 132 are arranged at both sides of the liquid discharge head 3, but instead the protective member 132 may be arranged only on one side of the liquid discharge head 3 as illustrated in FIGS. 19A and 19B. Even when the protective member 132 is arranged only on one side of the liquid discharge head 3, bending of the liquid discharge head 3 in the inter-sheet direction can be reduced, like in the first and second example embodiments.

In the configuration illustrated in FIGS. 19A and 19B, the protective member 132 is not directly fixed to the channel member and is fixed to a head cover 134. The head cover 134 is fixed to the channel member and the protective member 132 is indirectly fixed to the channel member. Also, in this case, the effect of reducing bending of the liquid discharge head 3 can be obtained.

The present disclosure is directed to suppressing bending of the liquid discharge head in the inter-sheet direction, and it is expected that this effect is higher in a so-called page-wide liquid discharge head. Examples of the page-wide liquid discharge head include a liquid discharge head in which a distance from a recording element substrate located at one end in the longitudinal direction to a recording element substrate located at the other end is greater than or equal to 297 mm, or greater than or equal to 728 mm. Further, the present disclosure is applicable to a liquid discharge head (temperature adjustment head) having a configuration in which a discharge liquid is heated in a recording element substrate to manage the temperature. The present disclosure is also applicable to a recording apparatus capable of temporarily holding an intermediate image formed of a liquid discharged onto an image formation surface of an intermediate transfer member preliminarily heated, and bringing the intermediate image formed on the image formation surface into contact with a recording medium to transfer the intermediate image onto the recording medium. This is because, if such a heat source is provided in the liquid discharge head or the recording apparatus, deformation of the liquid discharge head, in particular, due to thermal expansion becomes significant.

According to the present disclosure, it is possible to prevent bending of the liquid discharge head, while protecting each electric wiring board against static electricity, mist, a physical contact, and the like.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2018-148579, filed Aug. 7, 2018, which is hereby incorporated by reference herein in its entirety.

What is claimed is:

1. A liquid discharge head comprising:

a recording element substrate including a discharge port configured to discharge a liquid;

a channel member configured to support the recording element substrate and supply the recording element substrate with the liquid;

an electric wiring board placed on the channel member in such a manner that the electric wiring board extends in a longitudinal direction of the liquid discharge head, the electric wiring board being configured to supply the recording element substrate with power; and a plate-like protective member directly or indirectly fixed to the channel member to cover the electric wiring board, wherein all parts of the channel member are arranged inside the plate-like protective member, wherein a surface of the plate-like protective member opposed to the channel member and a surface of the channel member opposed to the plate-like protective member are substantially parallel to each other, and wherein in a case where a direction in which the recording element substrate is viewed from the channel member is defined as downward, the protective member includes a first bent portion configured to be bent in a transverse direction of the liquid discharge head, the first bent portion being located at a position that is above an upper end of the channel member and below a midpoint of a line segment connecting the upper end of the channel member and an upper end of the protective member.

2. The liquid discharge head according to claim 1, further comprising a second bent portion configured to be bent in the transverse direction of the liquid discharge head, the second bent portion being located at a position above the midpoint of the protective member.

3. The liquid discharge head according to claim 1, wherein a reinforcing portion having a rigidity higher than that of the protective member is provided at an upper portion of the protective member.

4. The liquid discharge head according to claim 3, wherein the reinforcing portion includes a bent portion configured to be bent in the transverse direction of the liquid discharge head.

5. The liquid discharge head according to claim 2, wherein at least the first bent portion as one of the first bent portion and the second bent portion is provided in a continuous manner in the longitudinal direction.

6. The liquid discharge head according to claim 2, wherein at least the first bent portion as one of the first bent portion and the second bent portion is provided intermittently in the longitudinal direction.

7. The liquid discharge head according to claim 2, wherein at least the first bent portion as one of the first bent portion and the second bent portion is provided in a range from one end in the longitudinal direction of the protective member to another end of the protective member.

8. The liquid discharge head according to claim 2, wherein at least the first bent portion as one of the first bent portion and the second bent portion is provided in at least a partial area in the longitudinal direction of the protective member.

9. The liquid discharge head according to claim 2, wherein the first bent portion and the second bent portion are bent toward one of an inside or an outside of the liquid discharge head.

10. The liquid discharge head according to claim 1, wherein the protective member is joined with the channel member.

11. The liquid discharge head according to claim 1, further comprising a fixing member arranged on a surface side of the channel member that supports the recording element substrate, wherein the fixing member and the protective member are fixed together.

12. The liquid discharge head according to claim 11, wherein linear expansion coefficients of the protective member and the fixing member are greater or less than a linear expansion coefficient of the channel member.

13. The liquid discharge head according to claim 3, further comprising support members fixed to both ends in the longitudinal direction of the channel member to connect to an outside of the liquid discharge head, wherein the support members are fixed to one of the protective member and the reinforcing portion in such a manner that the support members are movable relatively to one of the protective member and the reinforcing portion in the longitudinal direction.

14. The liquid discharge head according to claim 1, wherein the protective members have electrical conductivity.

15. The liquid discharge head according to claim 1, wherein the recording element substrate includes a heater configured to heat and discharge the liquid.

16. The liquid discharge head according to claim 1, wherein the liquid discharge head is a page-wide liquid discharge head in which a plurality of the recording element substrates is arrayed.

17. The liquid discharge head according to claim 16, wherein the plurality of recording element substrates is arranged in a staggered manner in the longitudinal direction of the liquid discharge head.

18. The liquid discharge head according to claim 16, wherein the plurality of recording element substrates is linearly arranged in the longitudinal direction of the liquid discharge head.

19. The liquid discharge head according to claim 17, wherein a distance from the recording element substrate located at one end in the longitudinal direction to the recording element substrate located at another end is greater than or equal to 297 mm.

20. The liquid discharge head according to claim 17, wherein a distance from the recording element substrate located at one end in the longitudinal direction to the recording element substrate at another end is greater than or equal to 728 mm.

21. The liquid discharge head according to claim 1, wherein the recording element substrate includes an energy generating element configured to generate energy for discharging a liquid, and a pressure chamber including the energy generating element, and wherein a liquid contained in the pressure chamber is circulated in a space between the pressure chamber and an outside.

22. A recording apparatus comprising:

a recording element substrate including a discharge port for discharging a liquid;

a channel member configured to support the recording element substrate and supply the recording element substrate with the liquid;

an electric wiring board placed on the channel member in such a manner that the electric wiring board extends in a longitudinal direction of the liquid discharge head, the electric wiring board being configured to supply the recording element substrate with power; and a plate-like protective member directly or indirectly fixed to the channel member to cover the electric wiring board, wherein all parts of the channel member are arranged inside the plate-like protective member, wherein a surface of the plate-like protective member opposed to the channel member and a surface of the channel member opposed to the plate-like protective member are substantially parallel to each other, and wherein in a case where a direction in which the recording element substrate is viewed from the channel member is defined as downward, the protective member includes a first bent portion configured to be bent in a transverse direction of the liquid discharge head, the first bent portion being located at a position that is above an upper end of the channel member and below a midpoint of a line segment connecting the upper end of the channel member and an upper end of the protective member, wherein the recording apparatus further comprises an intermediate transfer member configured to temporarily hold an intermediate image formed of the liquid discharged from the liquid discharge head on an image formation surface, and wherein the intermediate image formed on the image formation surface of the intermediate transfer member is brought into contact with a recording medium and the intermediate image is transferred onto the recording medium.

* * * * *